US007798821B2

(12) United States Patent
Liu et al.

(10) Patent No.: US 7,798,821 B2
(45) Date of Patent: Sep. 21, 2010

(54) CABLE ASSEMBLY WITH AN ORGANIZER FOR ADJUSTING THE CABLE OUTLET

(75) Inventors: Su-Feng Liu, Kunshan (CN); Bin Xu, Kunshan (CN); Wei-Ya Cheng, Kunshan (CN); Li-Bin Wang, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/322,501

(22) Filed: Feb. 2, 2009

(65) Prior Publication Data

US 2009/0197438 A1 Aug. 6, 2009

(30) Foreign Application Priority Data

Feb. 1, 2008 (CN) ..... 2008 2 0031476 U
Feb. 1, 2008 (CN) ..... 2008 2 0031479 U

(51) Int. Cl.
*H01R 13/648* (2006.01)

(52) U.S. Cl. ..... 439/76.1; 439/459; 439/466

(58) Field of Classification Search ..... 439/76.1, 439/459, 466, 456, 465
See application file for complete search history.

(56) References Cited

U.S. PATENT DOCUMENTS 4,687,263 A * 8/1987 Cosmos et al. ..... 439/108
6,364,693 B1 * 4/2002 Stagg et al. ..... 439/467
6,416,354 B1 * 7/2002 Lee ..... 439/484
6,666,708 B2 * 12/2003 Saito ..... 439/466
7,448,897 B2 6/2006 Molex
7,175,444 B2 8/2006 Molex
7,189,102 B2 * 3/2007 Ermert et al. ..... 439/459
7,303,438 B2 12/2007 Dawiedczyk et al.
7,410,365 B2 * 8/2008 Wu ..... 439/76.1
7,585,180 B2 * 9/2009 Riner et al. ..... 439/459
7,601,010 B1 * 10/2009 Wu ..... 439/76.1

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

A cable assembly comprises an insulative housing defining a main body portion with a front face, an upper and a lower tongue portion respectively extending forwardly from a top and bottom side of the front face, and the main body portion defining a base section and an organizer angled with the base section, and the insulative housing defined by an upper cover and a lower cover engaged with the upper cover; a printed circuit board disposed in the insulative housing and defining a mating portion extending forwardly from the front face of the insulative housing and disposed between the upper and lower tongue portion and a rear portion opposite to the mating portion thereof; and a cable terminated to the rear portion of the printed circuit board and extending out of the insulative housing along the organizer of the insulative housing.

17 Claims, 14 Drawing Sheets

CABLE ASSEMBLY WITH AN ORGANIZER FOR ADJUSTING THE CABLE OUTLET

FIELD OF THE INVENTION

The present invention relates to a cable assembly, and more particularly to a easily assembled cable assembly with an insulative housing having an organizer to neatly arrange the cable received therein and for adjusting the cable outlet.

DESCRIPTION OF PRIOR ART

U.S. Pat. No. 7,303,438 B2 issued to Dawiedczyk etc. (hereinafter referred to as Dawiedczyk '438 patents) on Dec. 4, 2007 discloses a cable assembly (not labeled) defining a plug connector 300 and a cable 101 coupled to the plug connector 300, please referring to FIGS. 14 & 16 in the Dawiedczyk '438 patent. As shown, the plug connector 300 includes an insulative housing 301 defining a forward mating face 302, a circuit card 305 disposed in the insulative housing 301 with a projecting mating blade 304 forwardly extending from the forward mating face 302 and a trailing edge (not shown) opposite to the mating blade 304. Further, a cable 101 electrically connects to the circuit card 305 and rearward extends out of the plug connector 300 in a horizontal direction. In addition, the insulative housing 301 is integrative molding around a middle and rear section of the circuit card 305 and a front portion of the cable 101 processed by the machine. And U.S. Pat. No. 7,448,897 B2 issued to Dawiedczyk etc. on Nov. 11, 2008 also discloses a plug connector 100 with an insulative housing (not labeled) over-molding around the edge card 120, please referring to FIG. 1. Thus, the insulative housing 301 can not be enclosed the circuit card 305 and the cable 101 through the manual operation which is at lower cost and with higher productivity efficiency.

U.S. Pat. No. 7,175,444 B2 issued to Lang etc. (hereinafter referred to as Lang '444 patent) on Feb. 13, 2007 discloses a plug connector 400 defining an insulative housing (not labeled) assembled by a pre-molded frame 402 and a preformed body portion 470 in a front-to-rear direction, and a circuit card 450 disposed in the insulative housing, please referring to FIGS. 21 to 23 in the Lang '444 patent. As mentioned in the above, the insulative housing encloses the circuit board 450 by manual operation, however, the insulative housing of the plug connector 400 can not adjust the cable (not shown) outlet in different direction.

Please referring to FIGS. 1 to 8 and 14 to 16 in the Dawiedczyk '438 patent, the cables 101 all rearwardly exit out of the insulative 301 in a horizontal direction. It should be noted that the cable assembly is widely used in the server as an internal cable, whereas the internal space of the server will be limited due to the sever developed in a miniaturization trend increasingly. So the horizontal outlet direction of the cable may be not meet the practical applications in the server sometimes.

As discussed above, an improved cable assembly overcoming the shortages of existing technology is needed.

SUMMARY OF THE INVENTION

Accordingly, an object of the present invention is to provide a cable assembly with the cable outlet can be adjusted.

Accordingly, an another object of the present invention is to provide a cable assembly can be easily assembled by the manual operation to reduce the cost thereof and improve the assembling efficiency thereof.

In order to achieve the object set forth, a cable assembly in accordance with the present invention comprises an insulative housing defining an insulative housing defining a main body portion with a front face, an upper and a lower tongue portion respectively extending forwardly from a top and bottom side of the front face, and the main body portion defining a base section and an organizer angled with the base section, and the insulative housing defined by an upper cover and a lower cover engaged with the upper cover; a printed circuit board disposed in the insulative housing and defining a mating portion extending forwardly from the front face of the insulative housing and disposed between the upper and lower tongue portion and a rear portion opposite to the mating portion thereof; and a cable terminated to the rear portion of the printed circuit board and extending out of the insulative housing along the organizer of the insulative housing.

In order to achieve another object set forth, a cable assembly in accordance with the present invention comprises an insulative housing defining a L-shape main body portion with a front face and a pair of tongue portions extending forwardly from an upper and a lower side of the front face of the insulative housing, the insulative housing defined by an upper cover and a lower cover and with a receiving space therein; a printed circuit board disposed in the receiving space of the insulative housing, and defining a mating portion with a plurality of conductive pads thereon and a rear portion opposite to the mating portion with a plurality of conductive pads, the mating portion extending forwardly from the front face of the insulative housing; a plurality of cables having a portion received into the insulative housing and with a plurality of conductors therein attached to the conductive pads of the rear portion of the printed circuit board; and engaging means interlocking with the lower cover, the printed circuit board and the upper cover together.

Other objects, features and advantages of the invention will be apparent from the following detailed description taken in connection with the accompanying drawings.

DETAILED DESCRIPTION OF PREFERRED EMBODIMENTS

Figure 1:
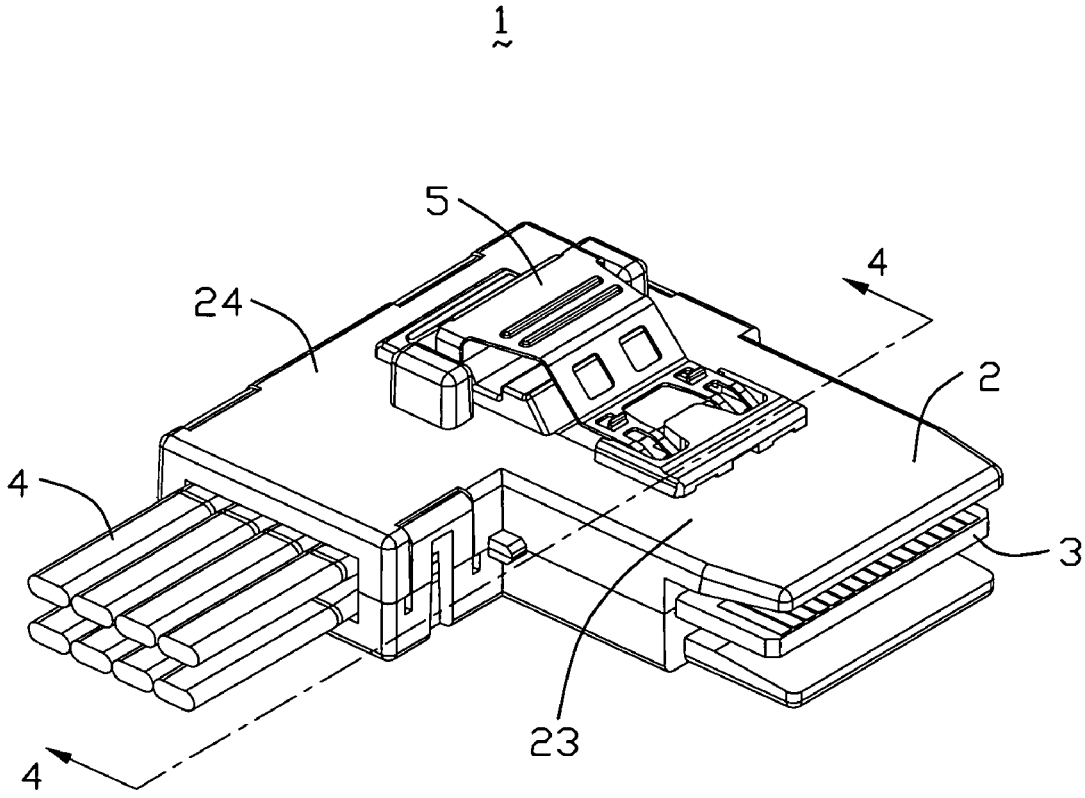
FIG. 1 is a perspective view of a cable assembly of a first embodiment in accordance with the present invention.

Reference will now be made to the drawing figures to describe the present invention in detail.

Figure 2:
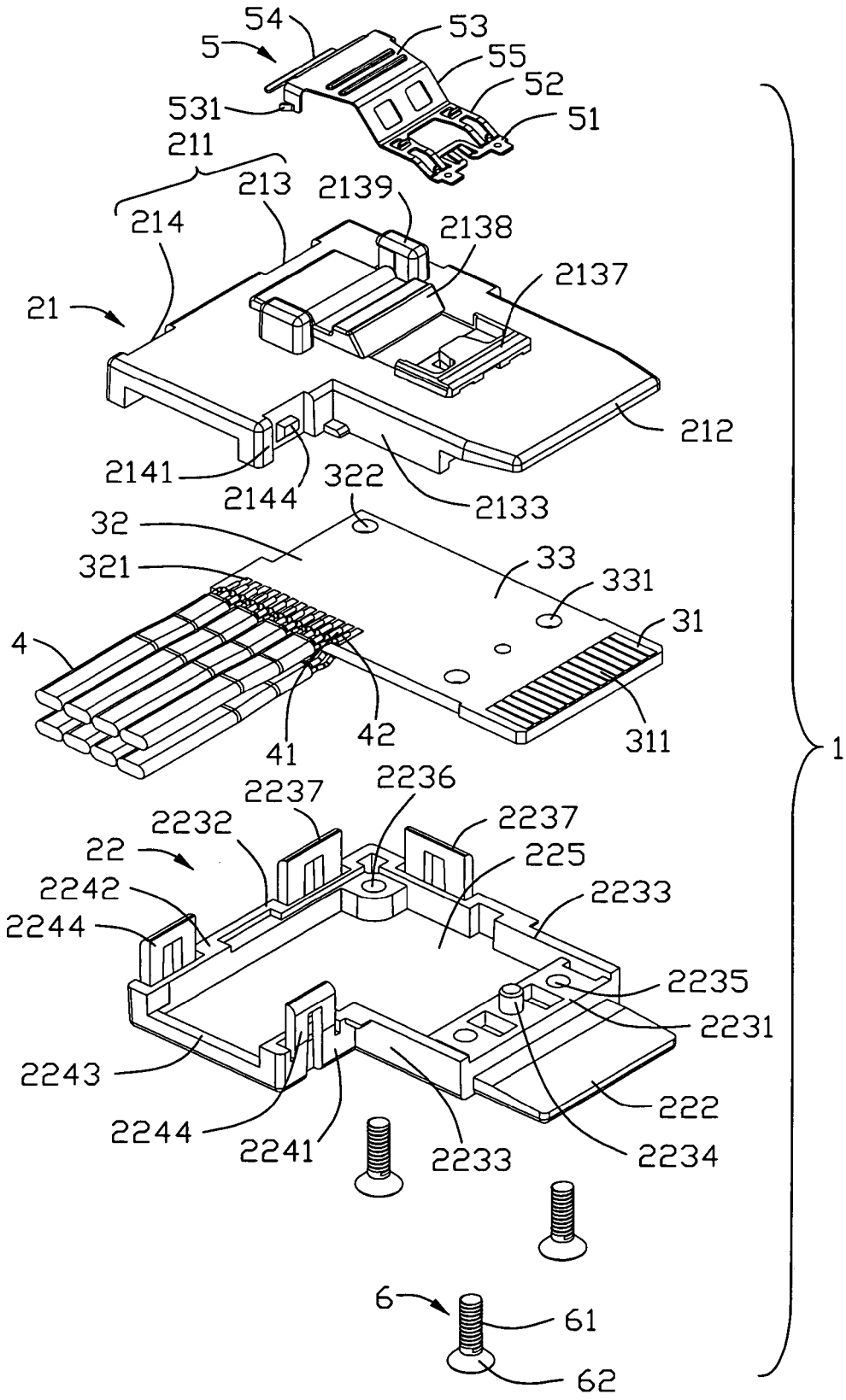
FIG. 2 is an exploded, perspective view of the cable assembly of FIG. 1.
Figure 3:
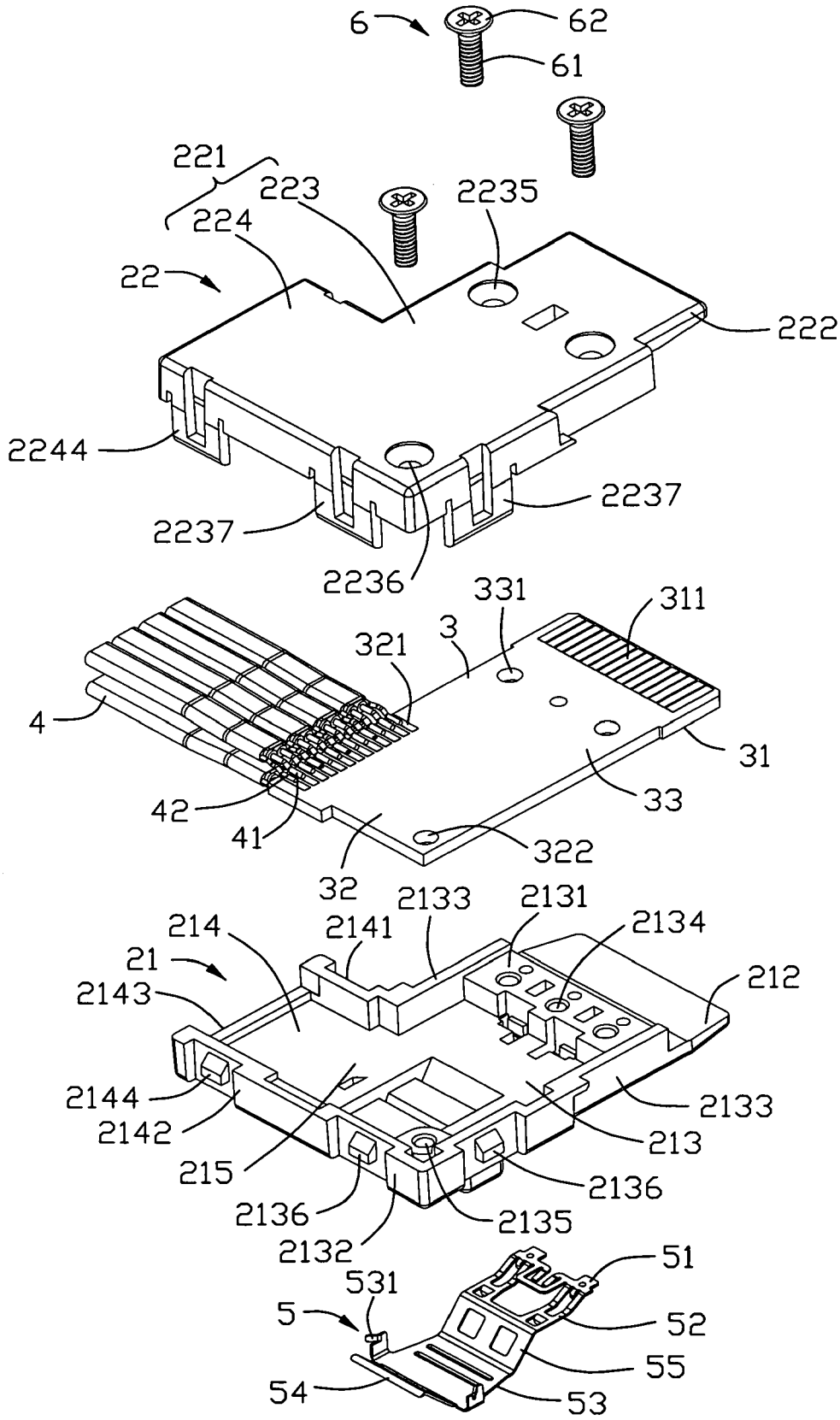
FIG. 3 is similar to FIG. 2, but viewed from another aspect.

Referring to FIGS. 1 to 3, a cable assembly 1 of the first embodiment made in accordance with the present invention includes an insulative housing 2, a printed circuit board 3 enclosed by the insulative housing 2, a number of cables 4 terminated to the printed circuit board 3 and extending out of the insulative housing 2, a locking member 5 assembled to the insulative housing 2 and three engaging means 6 locking with the insulative housing 2 and the printed circuit board 3.

The insulative housing 2 is configured by assembling of an upper cover 21 and a lower cover 22 which are all formed in advance. The insulative housing 2 defines a main body portion (not labeled) formed by a base section 23 and an organizer 24 extending leftward from the base section 23, and an upper tongue portion 212 and a lower tongue portion 22 respectively extending forwardly from a front face of the main body portion. The insulative housing 2 is made of plastic materials or other materials.

Referring to FIGS. 1 to 3, the upper cover 21 is generally L-shape and defines a main body portion 211 defining a front face and an upper tongue portion 212 extending forwardly for a preselected length from a top side of the front face of the main body portion 211. The main body portion 211 defines a base section 213 and a protrusive section 214 extending leftward from a left side of the base section 213. And the protrusive section 214 is perpendicular to the base section 213. A L-shape groove 215 is recessed from a bottom surface of the main body portion 211 to make the upper cover 21 defined by a top wall (not labeled) and a few of continuous side walls extending downwardly from peripheral sides of a bottom surface of the top wall. The continuous side walls includes a front wall 2131, a rear wall 2132, a pair of side walls 2133 of the base section 213 and a rear wall 2142, a front wall 2141, a side wall 2143 of the protrusive section 214. The rear wall 2142 extends leftward from a left side of the rear wall 2132 in a widthwise direction and is in line with the rear wall 2132 of the base section 213. The front wall 2141 of the protrusive section 214 extends leftward from a rear end of one side wall 2133 in a widthwise direction. The front wall 2131 defines a channel (not labeled) for supporting a section of the printed circuit board 3 and defines three circular holes 2134 therein. A supporting block (not labeled) is formed on the joint of the side wall 2133 and the rear wall 2132 of the base section 213 for supporting a corner of the printed circuit board 3 and defines a receiving hole 2135 therein. The side wall 2133 and the rear wall 2132 of the base section 213 both defines a wedge-shape block 2136 thereof. The front wall 2141 and the rear wall 2142 of the protrusive section 214 both defines a wedge-shape block 2144 thereof. The side wall 2143 of the protrusive section 214 defines a channel (not labeled) for the cables 4 passing through. The base section 213 of the upper cover 21 defines a generally M-shape interferential portion 2137 on a top surface thereof. The base section 213 further defines a platform portion 2138 protruding upward from a bottom surface of the top wall thereof and a pair of ear sections 2139 disposed at two sides of the platform portion 2138.

The lower cover 22 includes a main body portion 221 defining a front face (not labeled) and a lower tongue portion 222 extending forwardly for a preselected length from a bottom side of the front face of the main body portion 221. The main body portion 221 defines a longitudinal base section 223 and a transverse protrusive section 224 extending leftward from a left side of the base section 223. And the protrusive section 224 is perpendicular to the base section 223. A L-shape groove 225 is recessed from a top surface of the main body portion 221 to make the lower cover 22 defined by a bottom wall (not labeled) and a few of continuous side walls extending upwardly from peripheral sides of a top surface of the bottom wall. The continuous side walls includes a front wall 2231, a rear wall 2232, a pair of side walls 2233 of the base section 223 and a rear wall 2242, a front wall 2241, a side wall 2243 of the protrusive section 224. The rear wall 2242 extends from left side of the rear wall 2232 in a widthwise direction and is in line with the rear wall 2132 of the base section 213. The front wall 2241 of the protrusive section 224 extends leftward from a rear end of one side wall 2233 in a widthwise direction. The front wall 2231 of the base section 223 defines a channel (not labeled) for supporting a section of the printed circuit board 3 and further defines two circular through holes 2235 therein. A positioning post 2234 is formed in the channel and disposed between the two through holes 2235 for positioning the printed circuit board 3. A supporting block (not labeled) is formed on the joint of the side wall 2233 and the rear wall 2232 of the base section 223 for supporting a corner of the printed circuit board 3 and defines a through hole 2236 therein corresponding to the receiving hole 2135 of the upper cover 21. One side wall 2233 and the rear wall 2232 of the base section 223 both defines a latch portion 2237 thereof. The rear wall 2232 further defines a slot (not labeled) for supporting another corner of the printed circuit board 3. The front wall 2241 and the rear wall 2242 of the protrusive section 224 both defines a latch portion 2244 thereof. The side wall 2243 of the protrusive section 224 defines a channel (not labeled) for the cables 4 passing through.

Figure 4:
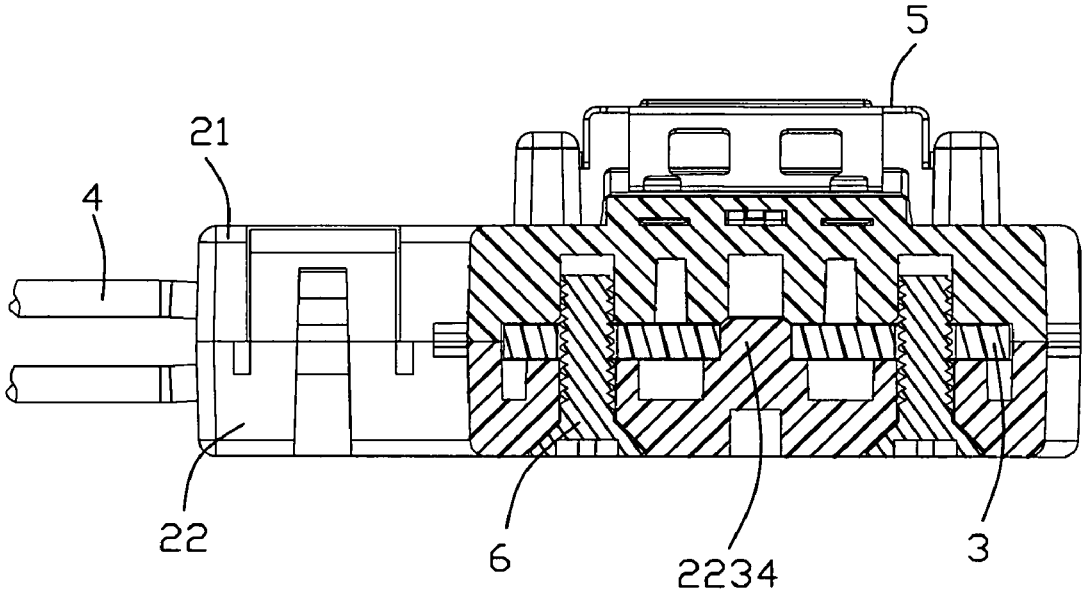
FIG. 4 is a cross section view of the cable assembly of FIG. 1 taken along line 4-4.

Referring to FIGS. 2 to 4, the print circuit board 3 defines a mating portion 31 with a plurality of conductive pads 311 for mating with a mating connector (not shown in FIGS.), a rear portion 32 opposite to the mating portion 31 with a plurality of conductive pads 321 for terminating to a plurality of cables 4 and a middle portion 33 connected with the mating portion 31 and the rear portion 32. The conductive pads 311 are arranged on opposite upper and lower surfaces of the mating portion 31 of the printed circuit board 3 in a transverse direction. The conductive pads 321 are arranged on opposite upper and lower surfaces of one lateral side of the rear portion 32 of the printed circuit board 3 in a longitudinal direction. The print circuit board 3 further defines three through holes 331 disposed at the middle portion 33 thereof and arranged in a widthwise direction and a through hole 322 disposed at a corner of the rear portion 32 thereof. A middle through hole 331 of the three through holes 331 is arranged for receiving the positioning post 2234 of the lower cover 22. The through hole 322 is corresponding to the receiving hole 2135 of the upper cover 21 and a through hole 2236 of the lower cover 22. The mating portion 31 is wider than middle portion 33 and the rear portion 32 so that the mating portion 31 will be stopped by a front face of the insulative housing 2.

Referring to FIGS. 2 and 3, the cable 4 comprises two sets of sub-assemblies in a stacked relationship. Each sub-assembly comprises four serial Attached Technology Attachment (ATA) standard cables 4 for high speed signal transmission. Each Serial ATA standard cable 4 comprises a pair of signal conductors 41 respectively transmitting positive signal and negative signal, and a pair of grounding conductors 42 arranged at opposite outer sides of the pair of signal conductors 41 for providing grounding to the signal transmission.

Referring to FIGS. 2 and 3, the locking member 5 is stamped and formed from a metallic plate and comprises a retaining portion 51, a pair of generally L-shape locking portions 52 extending upwardly and rearwardly from the retaining portion 51, a N-shape pressing portion 53 formed at a rear position of the pair of locking portions 52, and an inclined supporting portion 54 slantwise extending from the pressing portion 53. The locking member 5 further defines an inclined intermediate portion 55 connecting the pressing portion 53 with the locking portions 52. The pressing portion 53 defines a pair of spring tab 531 disposed at two sides thereof.

Referring to FIGS. 2 to 4, the three engaging means 6, such as screws, are used for locking with the upper cover 21, the printed circuit board 3 and the lower cover 22. Each screw 6 defines a cylindrical thread portion 61 and an operating portion 62.

Referring to FIGS. 1 to 4, the assembling process of the cable assembly 1 of the first embodiment made in according to the present invention starts from arranging the cables 4 into two levels and soldering the signal conductors 41 and the grounding conductors 42 of the Serial ATA standard cable 4 to the conductive pads 321 of the rear portion 32 the printed circuit board 3. The cables 4 are all perpendicular to the printed circuit board 3 when the soldering process is finished.

After the cables 4 are soldered to the printed circuit board 3, then assembling the cables 4 and the printed circuit board 3 together to the lower cover 22. The printed circuit board 3 is supported by the front wall 2231, the rear wall 2232 and a supporting block (not labeled) of the lower cover 22. The middle portion 33 of the printed circuit board 3 is disposed in the channel (not labeled) of the front wall 2231. The positioning post 2234 disposed in the channel passes through the hole 331 of printed circuit board 3. And, as the mating portion 31 is wider than the middle portion 33, so that the mating portion 31 is stopped by the front wall 2231 of the lower cover 22 in a front-to-rear direction. One corner of the rear portion 32 of the printed circuit board 3 is supported by the supporting block and another corner of the rear portion 32 of the printed circuit board 3 is supported by the rear wall 2232 of the lower cover 22. The cables 4 extend out of the lower cover 22 through the channel of the side wall 2243 of the lower cover 22 in a left direction.

After the printed circuit board 3 and the cables 4 are together assembled to the lower cover 22, then assembling the upper cover 21 to the lower cover 22. The latch members 2237, 2244 of the lower cover 22 are respectively engaged with the wedge-shape blocks 2136, 2144 formed on the continuous side walls of the upper cover 21 so that the upper cover 21 and the lower cover 22 are latched with each other. The top end of the positioning post 2234 of the lower cover 22 is attached to the opening of circular holes 2134. The insulative housing 2 is formed after the upper cover 21 and the lower cover 22 latched with each other. Thus, the insulative housing 2 defines a main body portion (not labeled) formed by the main body portions 211, 221 of the upper and lower cover 21, 22, an upper tongue portion 212 and a lower tongue portion 222 respectively extending forwardly from the upper and lower side of the front face of the main body portion thereof. The main body portion defines a base section 23 included by a pair of base sections 213, 223 and an organizer 24 included by a pair of protrusive sections 214, 224. The main body portion of the insulative housing 2 defines a front opening (not labeled) formed by a pair of channels respectively defined in the front wall 2131, 2231 of the upper and lower cover 21, 22. The insulative housing 2 defines a receiving space (not labeled) therein formed by a pair of grooves 215, 225 respectively defined in the upper cover 21 and lower cover 22. The organizer 24 of the insulative housing is used to adjust the cable 4 outlet. The rear and middle portion 32, 33 of the printed circuit board 3 can be inserted into the receiving space through the front opening of the insulative housing 2. The mating portion 31 of the printed circuit board 3 extends forwardly from the front face of the insulative housing 2 and disposes between the upper and lower tongue portions 212, 222. The mating portion 31 is paralleled and spaced with the upper and lower tongue portions 212, 222. The mating portion 31 of the printed circuit board 3 and upper and lower tongue portions 212, 222 all have respective width, the width of the mating portion 31 is less than the width of the upper tongue portion 212 but greater than the width of the lower tongue portion 222. The main body portion of the insulative housing 2 defines a lateral opening (not labeled) formed by a pair of channels respectively defined in the side wall 2143, 2243 of the protrusive section 214, 224 of the upper and lower cover 21, 22. The cables 4 exit out of the insulative housing 2 through the lateral opening. The soldering points of the print circuit board 3 and the cables 4 are disposed in the receiving space of the insulative housing 2.

After the upper cover 21 is assembled to the lower cover 22, then assembling three screws 6 to the insulative housing 2. The thread portions 61 of the three screws 6 pass through the three corresponding through holes 2235, 2236 of the lower cover 22 and three through holes 331, 322 defined in the printed circuit board 3 in a spiral movement, at last the distal ends of the three screws 6 are received into the two circular holes 2134 and a receiving hole 2135 defined in the upper cover 21. Thus, the upper cover 21, the lower cover 22 and the printed circuit board 3 are engaged with each other by the three screws 6.

Finally, assembling the locking member 5 to the top wall (not labeled) of upper cover 21 of the insulative housing 2. A forward pressing force is exerted on the locking member 5. The retaining portion 51 is engaged with the interferential portion 2137 to make the locking member 5 positioned on the insulative housing 2. The pressing portion 53, the inclined supporting portion 54, the inclined intermediate portion 55 and the locking portions 52 are cantilevered relative to the retaining portion 51 and disposed at upside of the platform portion 2138. The pair of spring tabs 531 are respectively received into a pair of recess (not labeled) formed in the pair of ear sections 2139. The ear section 2139 can prevent the locking member 5 excessive rebound when the operator withdraw a downward force exerted on the pressing portion 53.

Figure 5:
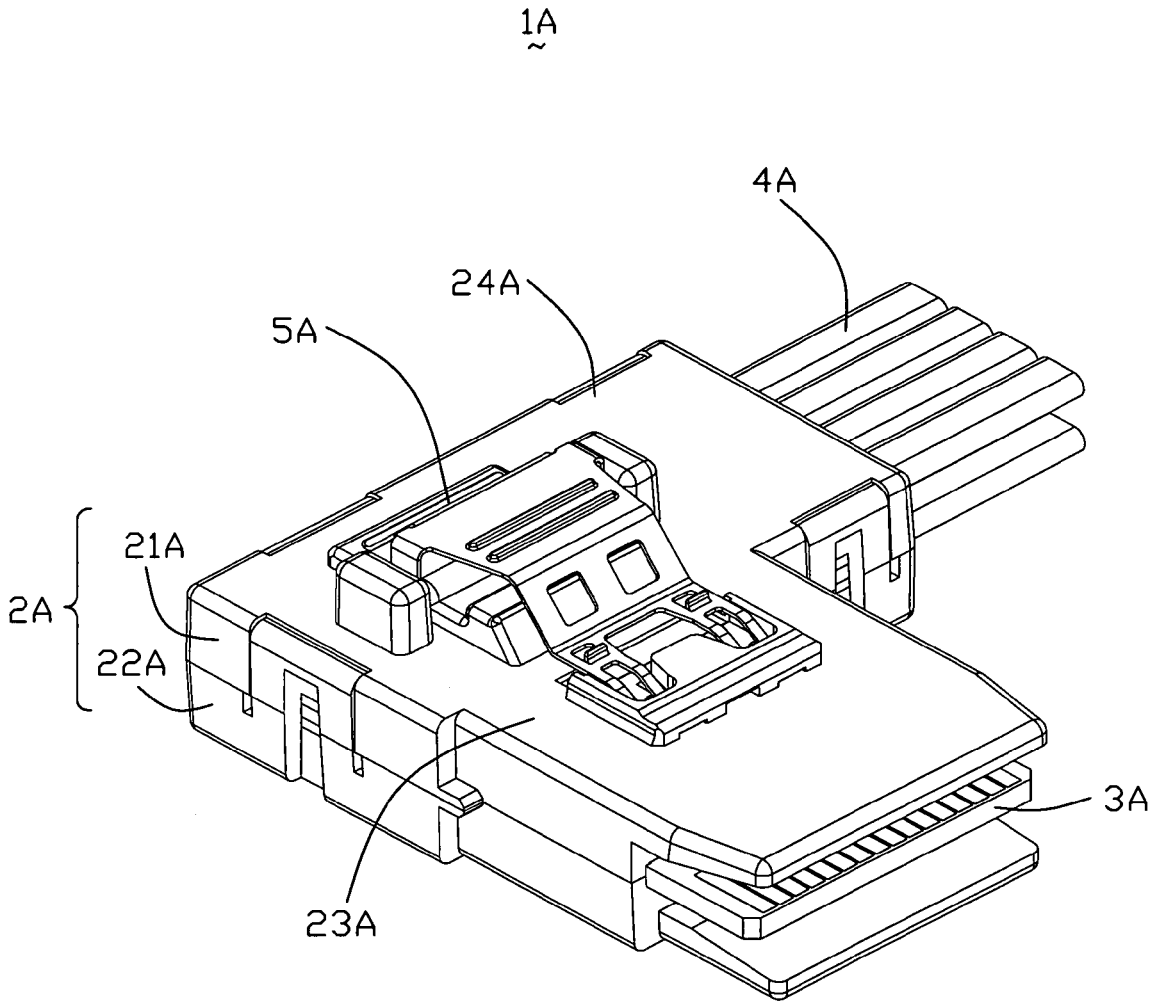
FIG. 5 is a perspective view of a cable assembly of a second embodiment in accordance with the present invention.
Figure 6:
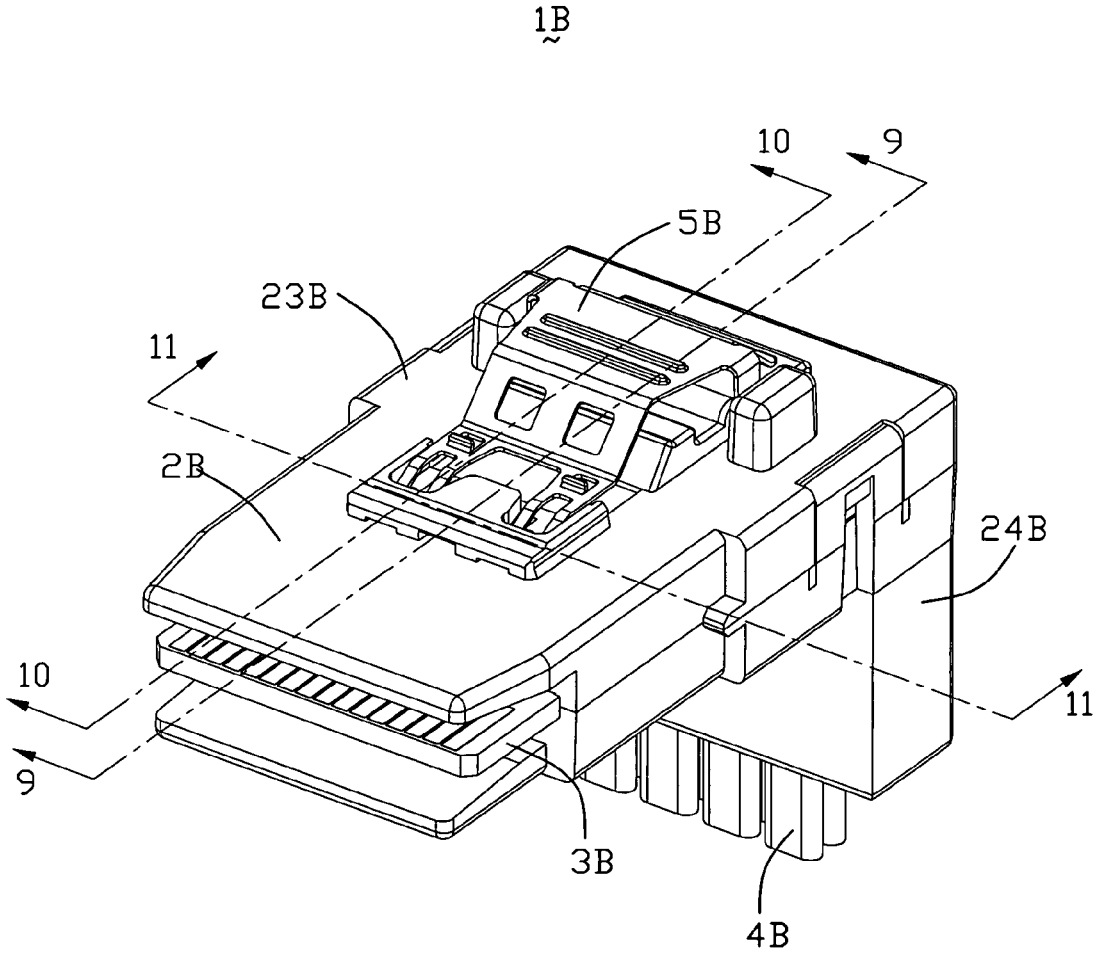
FIG. 6 is a perspective view of a cable assembly of a third embodiment in accordance with the present invention.

Referring to FIG. 5, a cable assembly 1A of the second embodiment made in accordance with the present invention comprises a printed circuit board 3A, a number of cables 4A terminated to the printed circuit board 3A, a locking member 5A and three engaging means (not shown in the FIG. 5) corresponding to the element members in the first embodiment and an insulative housing 2A enclosing the printed circuit board 3A and with a structure different from the insulative housing 2 shown in the first embodiment. The insulative housing 2A is also configured by assembling of an upper cover 21A and a lower cover 22A which are all pre-formed. The insulative housing 2A defines a base section 23A and an organizer 24A extending rightward from a right side of the base section 23A to make the cables 4B extend out of the insulative housing 2A in a right direction. So the cable outlet of the cable assembly 1 is contrary to the cable outlet of the cable assembly 1A.

In addition, the steps of assembling the cable assembly 1A are the same with the steps of assembling the cable assembly 1.

After the above assembling steps, the entire process of assembling the cable assembly 1, 1A is finished.

Referring to FIGS. 6 to 11, a cable assembly 1B of the third embodiment made in accordance with the present invention is similar to the cable assembly 1, 1A and includes an insulative housing 2B, a printed circuit board 3B enclosed by the insulative housing 2B, a number of cables 4B terminated to the printed circuit board 3B and extending out of the insulative housing 2B, a latch member 5B assembled to the insulative housing 2B and a pair of screws 6B locking with the insulative housing 2B and the printed circuit board 3B.

The insulative housing 2 is configured by assembling of an upper cover 21B and a lower cover 22B which are all formed in advance. The insulative housing 2B defines a base section 23B and an organizer 24B extending downward from a rear side of the base section 23B to make the cables 4B extend out of the insulative housing 2B in a downward direction. The insulative housing 2B is made of plastic materials or other materials.

Referring to FIGS. 7 to 11, the upper cover 21B defines a main body portion 211B defining a front face (not labeled) and an upper tongue portion 212B extending forwardly for a preselected length from a top side of the front face of the main body portion 211B. A groove 213B is recessed from a bottom surface of the main body portion 211B to make the upper cover 21 defined by a top wall (not labeled) and a few of continuous side walls (not labeled) extending downwardly from peripheral sides of a bottom surface of the top wall. The continuous side walls includes a front wall 2111B, a rear wall 2112B and a pair of side walls 2113B of the main body portion 211B. The front wall 2111B defines a channel (not labeled) for supporting a section of the printed circuit board 3 and defines three circular holes 2114B therein. The pair of side walls 2113B each defines a wedge-shape block 2115B thereof. The main body portion 211B of the upper cover 21B defines a generally M-shape interferential portion 214B on a top surface thereof. The main body portion 211B further defines a platform portion 215B protruding upward from a bottom surface of the top wall thereof and a pair of ear sections 216B disposed at two sides of the platform portion 215B.

The lower cover 22B includes a main body portion 221B defining a front face (not labeled) and a lower tongue portion 222B extending forwardly for a preselected length from a bottom side of the front face of the main body portion 221B. The main body portion 221B defines a base section 223B and a protrusive section 224B extending downward from a rear side of the base section 223B. And the protrusive section 224B is perpendicular to the base section 223B and defines a passage 2241B therein for the cables 4B extending out of the lower cover 22B. A groove 225B is recessed from a top surface of the main body portion 221B to make the lower cover 22B defined by a bottom wall (not labeled) and a few of continuous side walls (not labeled) extending upwardly from peripheral sides of a top surface of the bottom wall. The continuous side walls includes a front wall 2231B, a rear wall 2232B and a pair of side walls 2233B of the base section 223B. The front wall 2231B of the base section 223B defines a channel (not labeled) for supporting a section of the printed circuit board 3B and further defines two circular through holes 2235B therein. A positioning post 2234B is formed in the channel and disposed between the two through holes 2235B for positioning the printed circuit board 3B. The pair of side walls 2233B each defines a latch portion 2236B thereof for engaging with the wedge-shape block 2115B of the pair of side walls 2113B of the upper cover 21.

Figure 7:
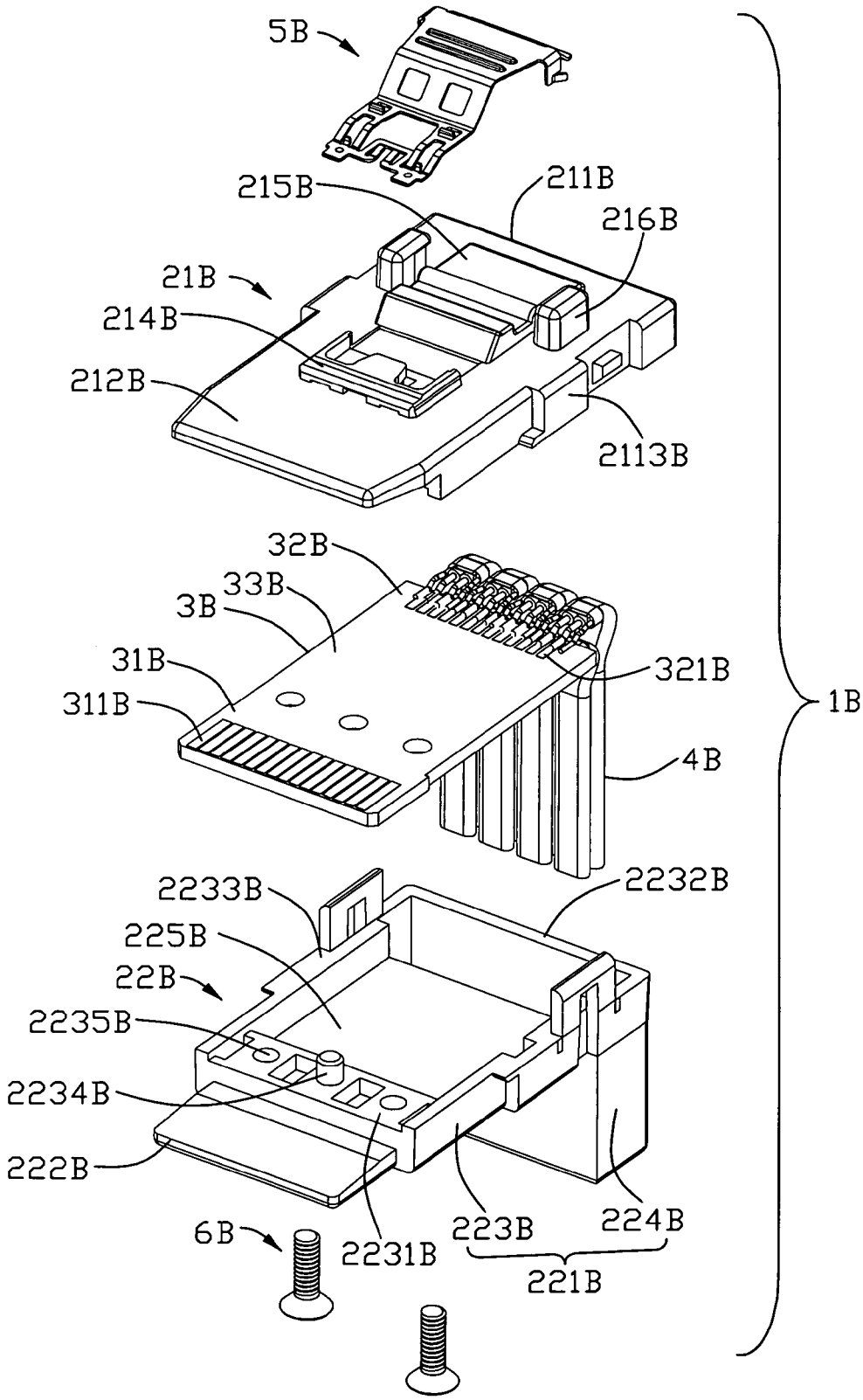
FIG. 7 is an exploded, perspective view of the cable assembly of FIG. 6.
Figure 8:
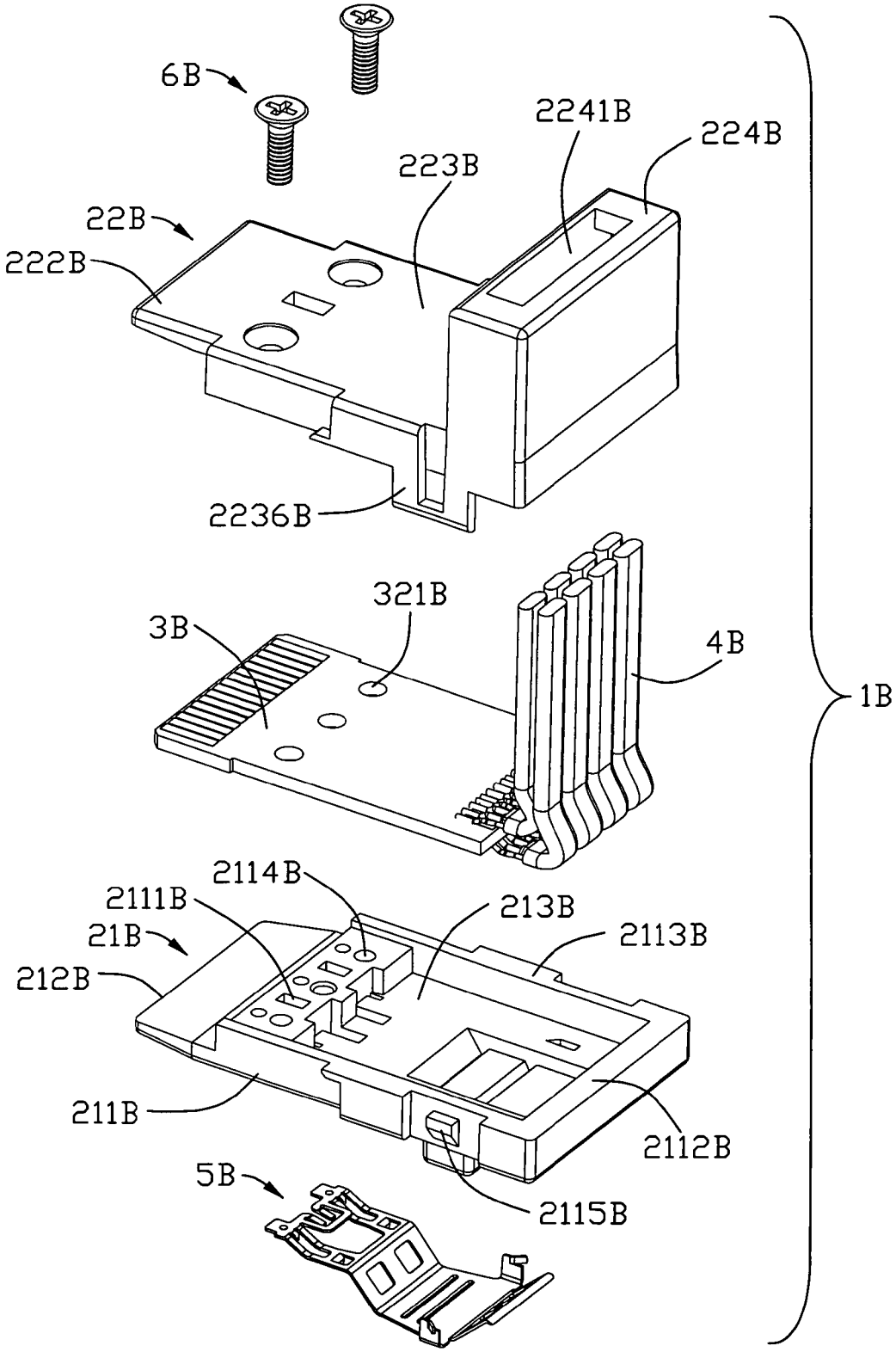
FIG. 8 is an another exploded, perspective view of the cable assembly of FIG. 7.
Figure 9:
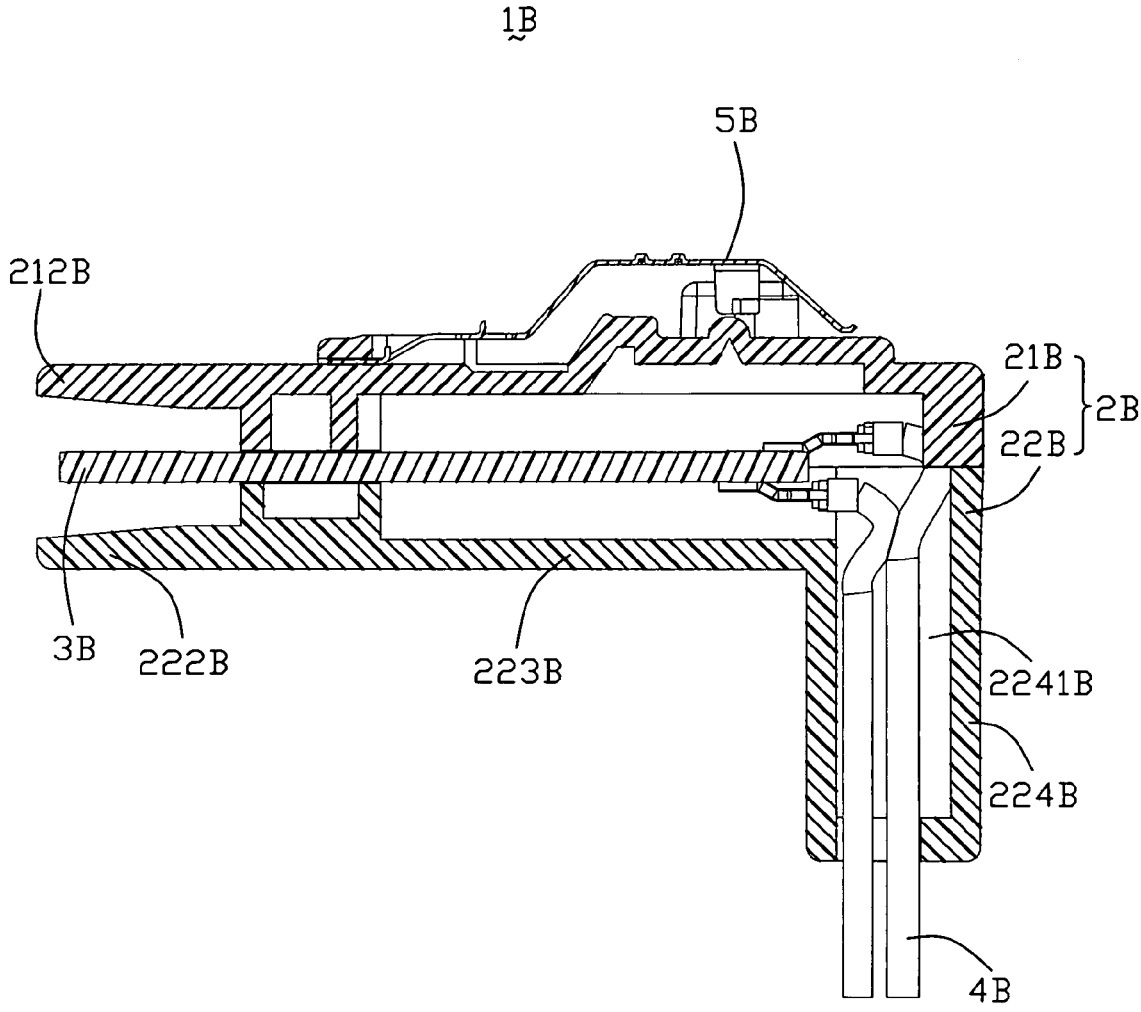
FIG. 9 is a cross section view of the cable assembly of FIG. 6 taken along line 9-9.
Figure 10:
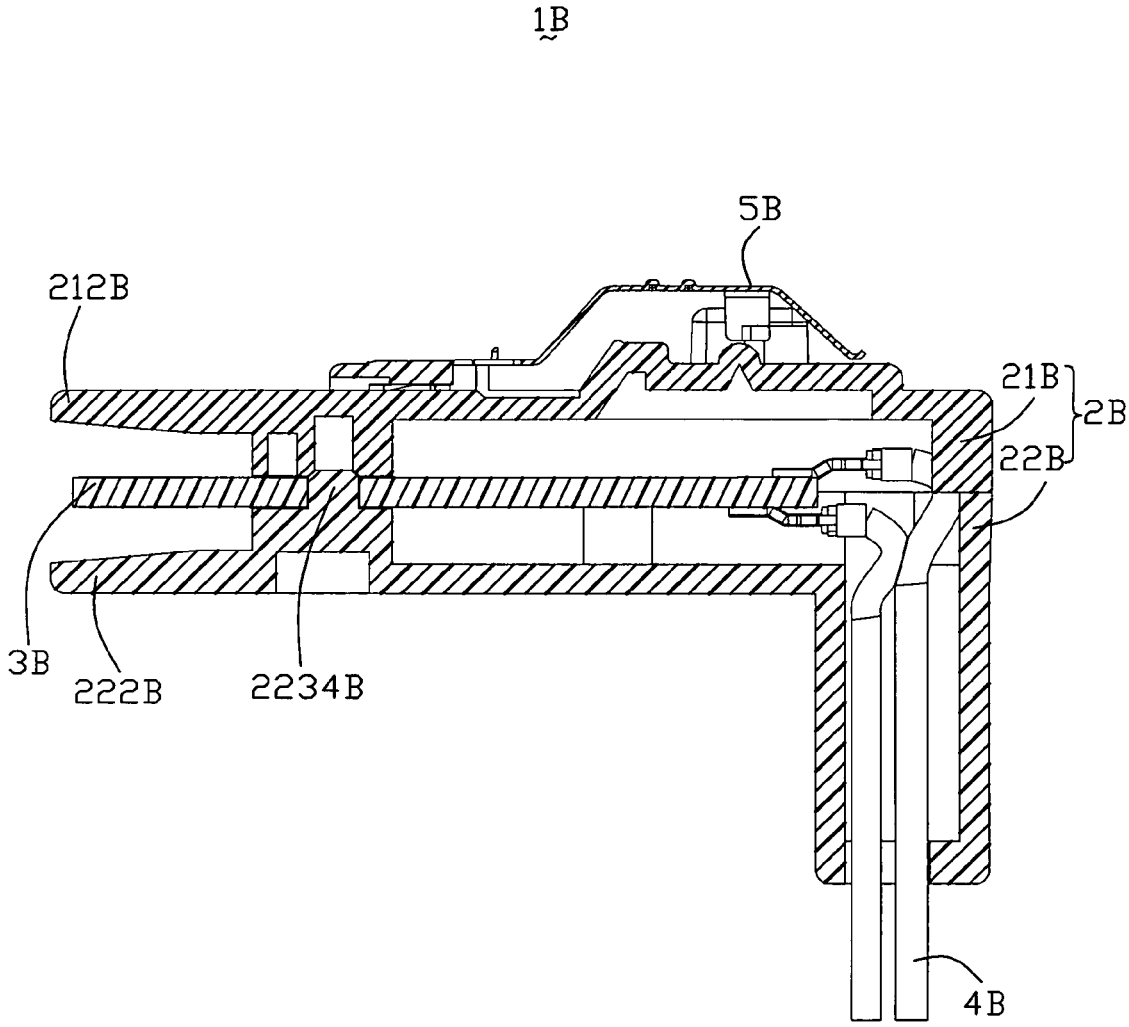
FIG. 10 is a cross section view of the cable assembly of FIG. 6 taken along line 10-10.
Figure 11:
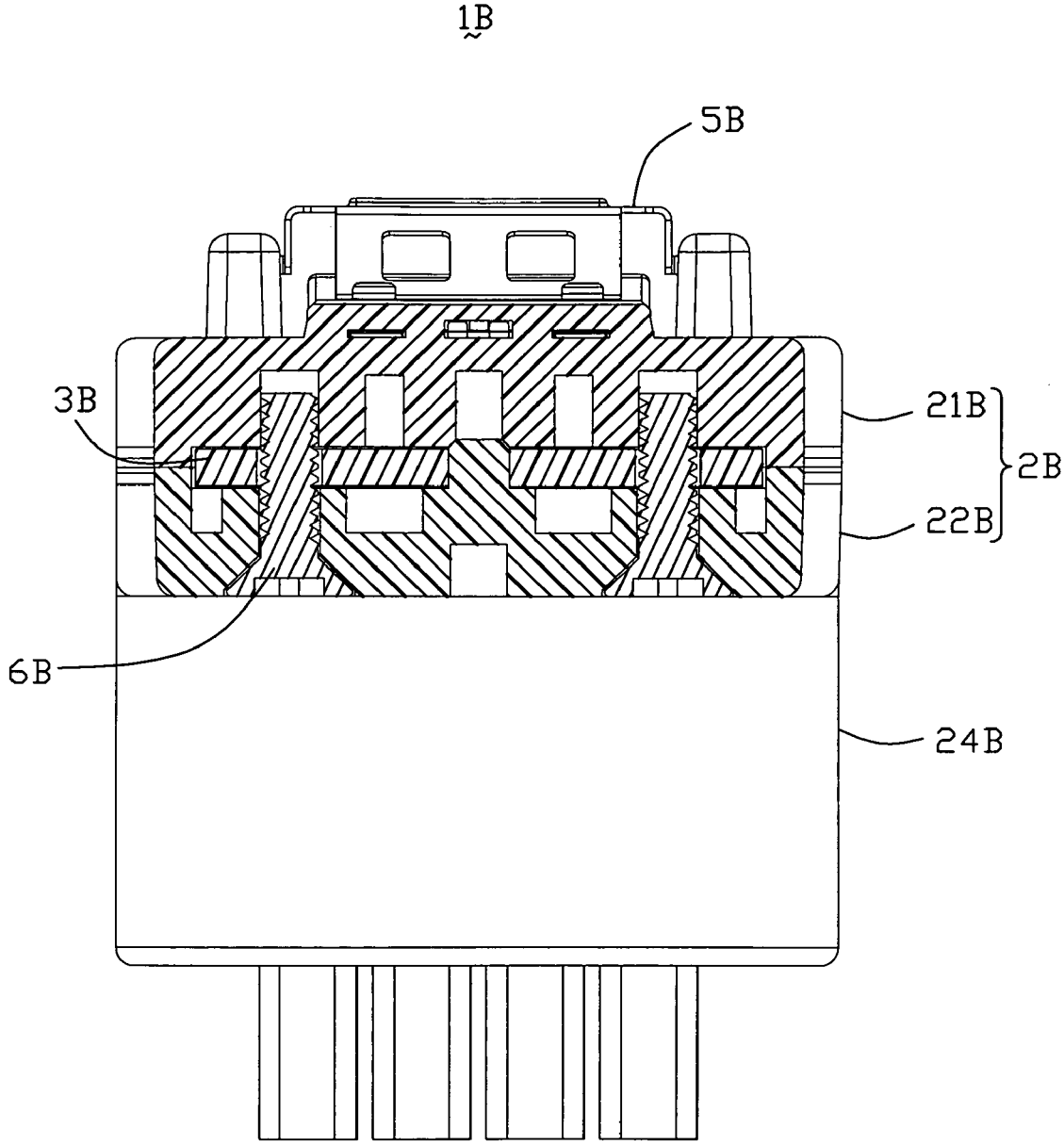
FIG. 11 is a cross section view of the cable assembly of FIG. 6 taken along line 11-11.

Referring to FIGS. 7 to 8, the print circuit board 3B defines a mating portion 31B with a plurality of conductive pads 311B for mating with a mating connector (not shown in FIGS.), a rear portion 32B opposite to the mating portion 31B with a plurality of conductive pads 321B for terminating to a plurality of cables 4B and a middle portion 33B connected with the mating portion 31B and the rear portion 32B. The conductive pads 311B are arranged on opposite upper and lower surfaces of the mating portion 31B of the printed circuit board 3B in a transverse direction. The conductive pads 321B are arranged on opposite upper and lower surfaces of the rear portion 32B of the printed circuit board 3B in a transverse direction. The print circuit board 3B further defines three through holes 331B disposed at the middle portion 33B thereof and arranged in a widthwise direction. A middle through hole 331B of the three through holes 331B is arranged for receiving the positioning post 2234B of the lower cover 22B. A pair of side through holes 331B of the three through holes 331B are corresponding to the two circular holes 2114B of the upper cover 21B and two through hole 2235B of the lower cover 22B. The mating portion 31B is wider than middle portion 33B and the rear portion 32B so that the mating portion 31B will be stopped by a front face of the insulative housing 2B.

Referring to FIGS. 7 and 8, the cable 4B, the locking member 5B and the engaging means 6B of the cable assembly 1B are the same with the corresponding element members in the first and second embodiments of the present invention.

Referring to FIGS. 6 to 11, the assembling process of the cable assembly 1B of the third embodiment made in according to the present invention starts from soldering the cables 4B to the printed circuit board 3B, then assembling the printed circuit board 3B to the lower cover 22B and the cables 4B bent downward and extending out of the lower cover 22B through the passage 2241B of the protrusive section 224B thereof, then assembling the upper cover 21B to the lower cover 22B and engaged with lower cover 22, then assembling a pair of the screws 6B to the insulative housing 2B interlocking with the lower cover 22B, the printed circuit board 3B and the upper cover 21B together, at last assembling the latch member 5B to the upper cover 21B.

Figure 12:
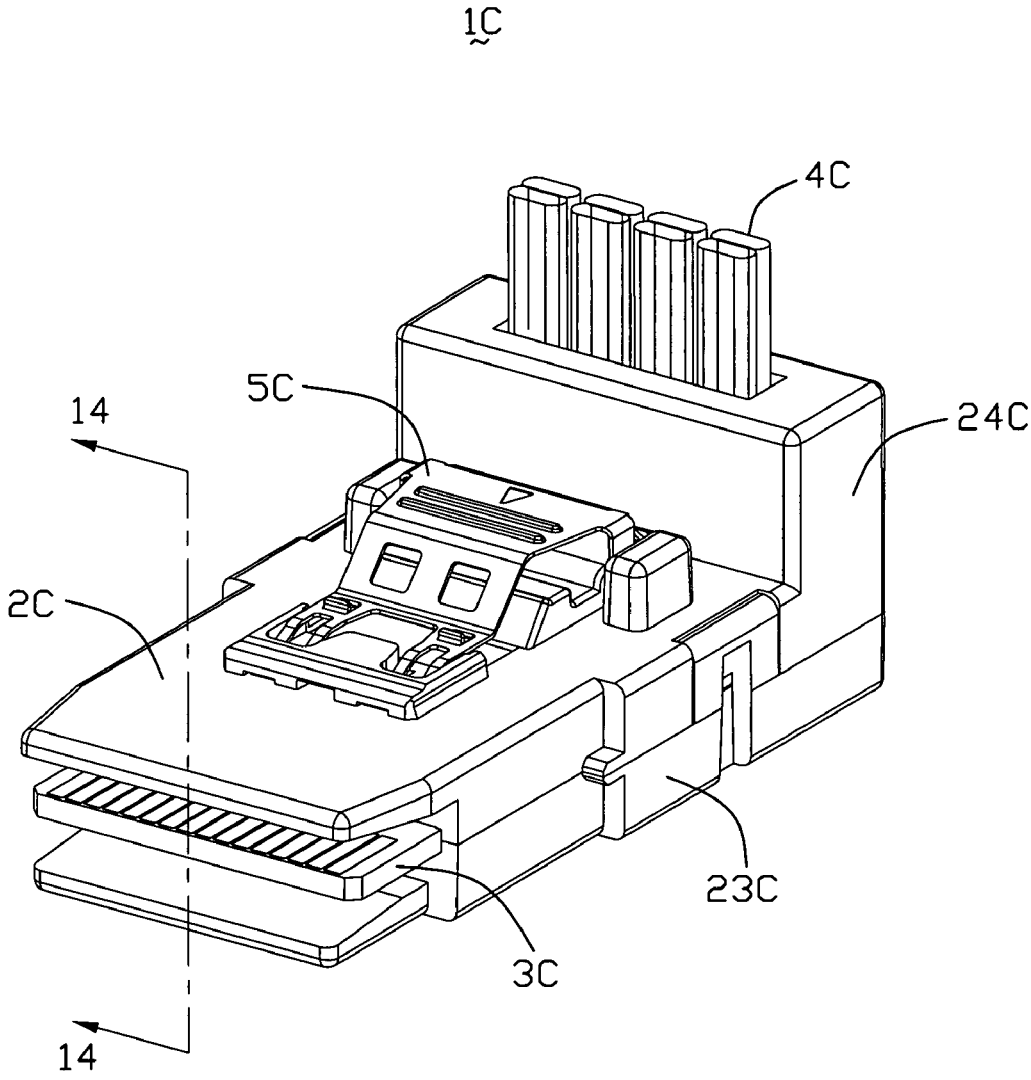
FIG. 12 is a perspective view of a cable assembly of a fourth embodiment in accordance with the present invention.
Figure 13:
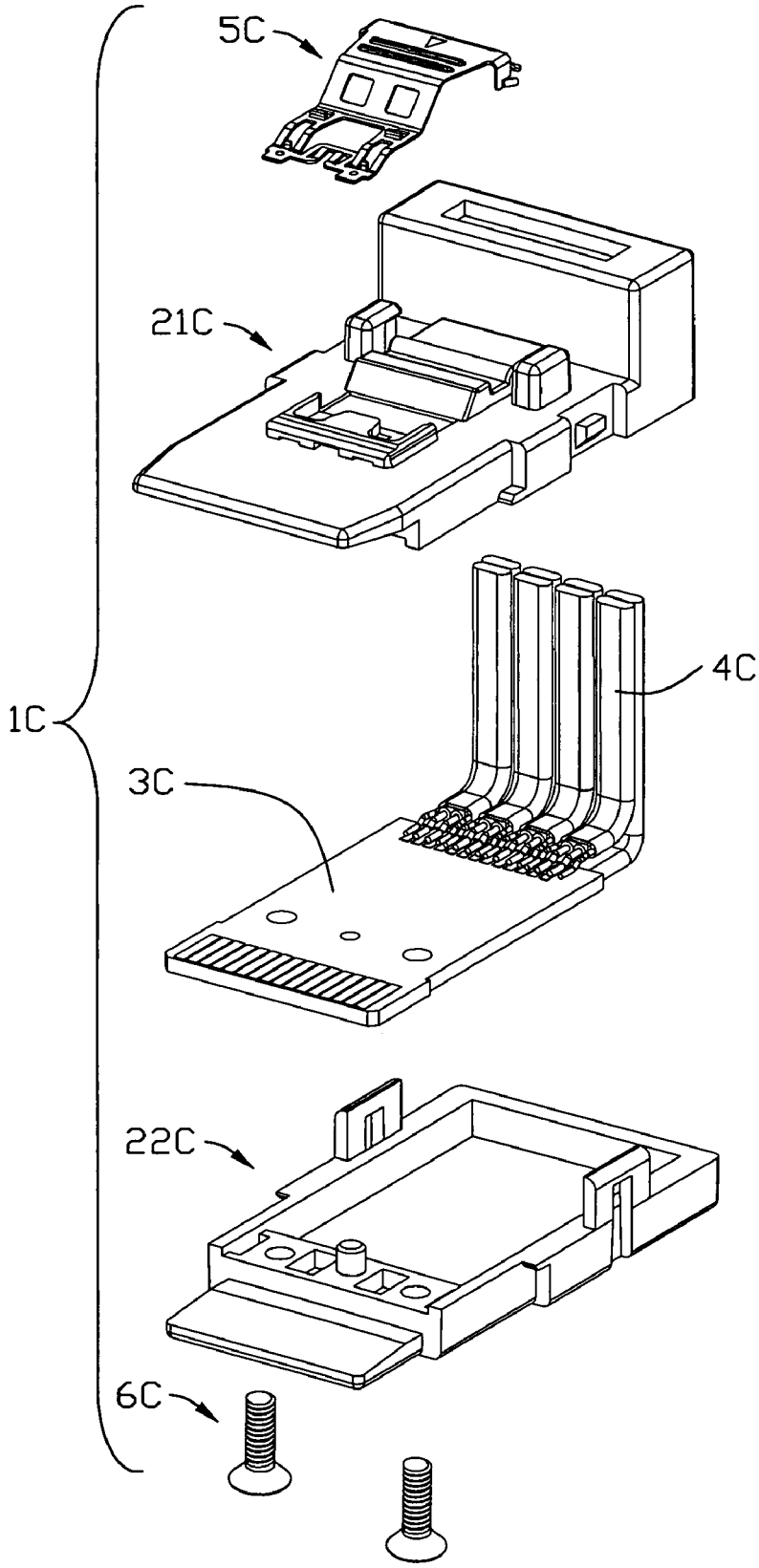
FIG. 13 is an exploded, perspective view of the cable assembly of FIG. 12.
Figure 14:
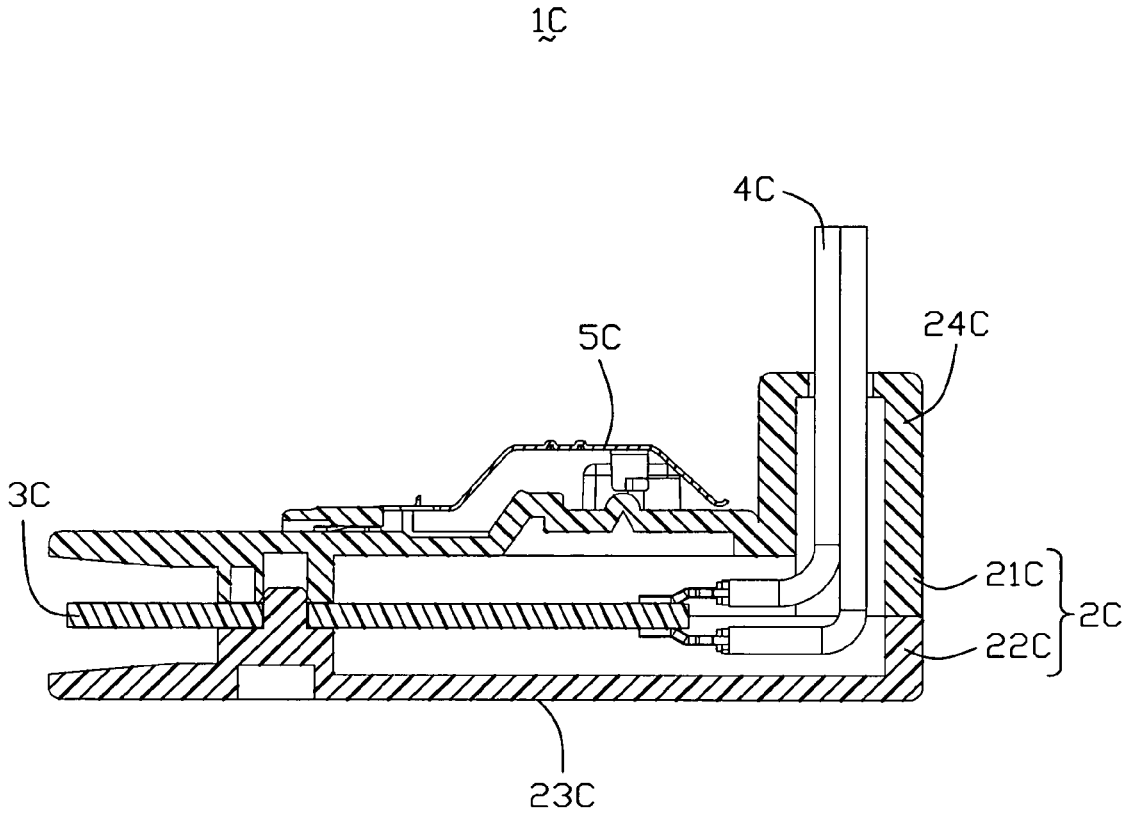
FIG. 14 is a cross section view of the cable assembly of FIG. 12 taken along line 14-14.

Referring to FIGS. 12 to 14, a cable assembly 1C of the fourth embodiment made in accordance with the present invention comprises a printed circuit board 3C, a number of cables 4C terminated to the printed circuit board 3C, a locking member 5C and a pair of engaging means 6C corresponding to the element members in the third embodiment and an insulative housing 2C enclosing the printed circuit board 3C and with a structure different from the insulative housing 2B shown in the third embodiment. The insulative housing 2C is also configured by assembling of an upper cover 21C and a lower cover 22C which are all pre-formed. The insulative housing 2C defines a base section 23C and an organizer 24C extending upward from a rear side of the base section 23C to make the cables 4C extend out of the insulative housing 2C in a upward direction. In other words, the organizer 24C extending upward from the rear side of the upper cover 21C is different from the organizer 24B extending downward from the rear side of the lower cover 22B. So the cable outlet of the cable assembly 1C is contrary to the cable outlet of the cable assembly 1B.

In addition, the steps of assembling the cable assembly 1C are the same with the steps of assembling the cable assembly 1B.

After the above assembling steps, the entire process of assembling the cable assembly 1B, 1C is finished.

What we claim is:

1. A cable assembly, comprising:

an insulative housing defining a main body portion with a front face, an upper and a lower tongue portions respectively extending forwardly from a top and bottom sides of the front face, the main body portion defining a base section and an organizer angled with the base section, the insulative housing being defined by an upper cover and a lower cover engaged with the upper cover;

a printed circuit board disposed in the insulative housing and defining a mating portion extending forwardly from the front face of the insulative housing and disposed between the upper and lower tongue portions and a rear portion opposite to the mating portion; and a cable terminated to the rear portion of the printed circuit board and extending out of the insulative housing along the organizer of the insulative housing;

wherein the engaging means comprises a screw, and each of the upper and lower covers and the printed circuit board has a hole for receiving the screw.

2. The cable assembly as recited in claim 1, wherein the organizer of the insulative housing is perpendicular to the base section of the insulative housing.

3. The cable assembly as recited in claim 1, wherein the organizer of the insulative housing extends upward from a rear side of the base section of the insulative housing.

4. The cable assembly as recited in claim 3, wherein the organizer is formed on the upper cover.

5. The cable assembly as recited in claim 1, wherein the main body portion of the insulative housing is formed by a pair of main body portions of the upper and the lower cover, and the upper and lower tongue portions of the insulative housing are respectively extending forwardly from a front face of the upper cover and the lower cover.

6. The cable assembly as recited in claim 1, further comprising an engaging means assembled to the insulative housing for locking the printed circuit board to the insulative housing.

7. The cable assembly as recited in claim 1, wherein the printed circuited board defines a middle portion connected with the mating portion and the rear portion, and the middle portion has a plurality of holes therein.

8. The cable assembly as recited in claim 7, wherein the lower cover defines a positioning post extending through one of the holes of the printed circuit board.

9. The cable assembly as recited in claim 1, further comprising a locking member assembled to a top surface of the insulative housing.

10. A cable assembly for mating with a complementary connector, comprising:

an insulative housing defining a L-shape main body portion with a front face and a pair of tongue portions extending forwardly from an upper and a lower side of the front face of the insulative housing, the insulative housing defined by an upper cover and a lower cover and with a receiving space therein;

a printed circuit board disposed in the receiving space of the insulative housing, and defining a mating portion with a plurality of conductive pads thereon and a rear portion opposite to the mating portion with a plurality of conductive pads, the mating portion extending forwardly from the front face of the insulative housing;

a plurality of cables having a portion received into the insulative housing and with a plurality of conductors therein attached to the conductive pads of the rear portion of the printed circuit board; and engaging means interlocking the lower cover, the printed circuit board and the upper cover together;

wherein the engaging means is a screw, and each of the upper and lower covers and the printed circuit board has a hole for allowing the screw to extend therethrough.

11. The cable assembly as recited in claim 10, wherein the conductive pads of the rear portion of the printed circuit board are formed on a rear edge of the rear portion of the printed circuit board.

12. The cable assembly as recited in claim 10, further including a latch attached to a top surface of the insulative housing.

13. The cable assembly as recited in claim 12, wherein the main body portion defines a base portion and an organizer vertical with the base portion, the organizer extends upward from the top surface of the insulative housing.

14. The cable assembly as recited in claim 13, wherein the organizer is integrative formed on the upper cover.

15. An electrical cable connector comprising:

first and second insulative covers discrete from and complementarily assembled with each other, said first and second insulative covers commonly defining a front base section facing toward an exterior in a first direction and defining a mating port for receiving a complementary connector therein, and a rear organizer section facing toward the exterior in a second direction perpendicular to said first direction for defining an outlet for extension of a plurality of cables; and a printed circuit board sandwiched between the first and second covers in said second direction, said cables mechanically and electrically connecting to a rear side of the printed circuit board in said first direction; wherein said first cover and said second cover define corresponding securing devices latched to each other for securing said first cover and said second cover together under condition that said securing devices are located by two sides of said cables adjacent to said outlet so as to efficiently restrain transverse movement of the cables relative to the combined first cover and second cover, and a deflectable latch for locking to the complementary connector, wherein said latch is located on a side of the combined first cover and said second cover, where the cables extend outward toward the exterior in said second direction.

16. The electrical cable connector as claimed in claim 15, wherein the printed circuit board is secured in position with regard to the first cover and the second cover via means which is unitarily with one of said first cover and said second cover.

17. The cable assembly as recited in claim 15, further comprising an engaging means assembled to the first and second insulative covers for locking the printed circuit board to the first and second insulative covers, and the engaging means comprising a screw, and each of the first and second insulative cover and the printed circuit board having a hole for receiving the screw.

* * * * *